US010281164B2

(12) United States Patent
Daley

(10) Patent No.: US 10,281,164 B2
(45) Date of Patent: May 7, 2019

(54) TRANSPORTABLE HUMIDIFIER

(71) Applicant: Terry Daley, Bonita Springs, FL (US)

(72) Inventor: Terry Daley, Bonita Springs, FL (US)

( * ) Notice: Subject to any disclaimer, the term of this patent is extended or adjusted under 35 U.S.C. 154(b) by 0 days.

(21) Appl. No.: 15/783,652

(22) Filed: Oct. 13, 2017

(65) Prior Publication Data

US 2018/0038604 A1 Feb. 8, 2018

Related U.S. Application Data

(63) Continuation-in-part of application No. 14/703,919, filed on May 5, 2015, now Pat. No. 10,036,564.

(60) Provisional application No. 62/072,197, filed on Oct. 29, 2014.

(51) Int. Cl.

| | |
|---|---|
| ***F24F 6/04*** | (2006.01) |
| ***B01F 5/04*** | (2006.01) |
| ***B01F 3/04*** | (2006.01) |
| *F24F 6/00* | (2006.01) |

(52) U.S. Cl.

CPC ..... *F24F 6/043* (2013.01); *B01F 3/04439* (2013.01); *B01F 5/04* (2013.01); *B01F 2215/0091* (2013.01); *F24F 2006/008* (2013.01); *F24F 2221/12* (2013.01)

(58) Field of Classification Search

CPC ..... F24F 6/043; B01F 3/04439; B01F 5/04; B01F 2215/0091

See application file for complete search history.

(56) References Cited

U.S. PATENT DOCUMENTS

| | | | | |
|---|---|---|---|---|
| 2,232,108 | A | 2/1941 | Giacomini | |
| 4,307,656 | A | 12/1981 | Vesper | |
| 6,019,355 | A | 2/2000 | Birdsell et al. | |
| 6,824,126 | B2 * | 11/2004 | Keller | F24F 6/043 261/106 |
| 10,036,564 | B2 | 7/2018 | Daley | |
| 2002/0195728 | A1 * | 12/2002 | Wooderson | F24F 6/043 261/102 |
| 2007/0119963 | A1 * | 5/2007 | DiBello | A61L 9/127 239/34 |
| 2007/0152356 | A1 | 7/2007 | Huang | |
| 2010/0187327 | A1 * | 7/2010 | Irvin | A61L 9/125 239/47 |
| 2016/0123611 | A1 | 5/2016 | Daley | |

OTHER PUBLICATIONS

Daley, Terry; Non-Final Office Action for U.S. Appl. No. 14/703,919, filed May 5, 2015, dated Nov. 14, 2017, 11 pgs.

Daley, Terry; Restriction Requirement for U.S. Appl. No. 14/703,919, filed May 5, 2015, dated Aug. 29, 2017, 6 pgs.

Daley, Terry; Corrected Notice of Allowability for U.S. Appl. No. 14/703,919, filed May 5, 2015, dated Jun. 28, 2018, 7 pgs.

(Continued)

*Primary Examiner* — Queenie S Dehghan

(74) *Attorney, Agent, or Firm* — Taylor English Duma LLP

(57) ABSTRACT

A humidifier includes a container defining a container cavity; a cover positioned over a container opening of the container cavity, the cover defining a body opening and a vent opening, the body opening and the vent opening in fluid communication with the container cavity; an attachment mechanism configured to attach the humidifier to a vent; and a wicking pad mounted in the container cavity between the vent opening and the body opening.

19 Claims, 10 Drawing Sheets

(56) References Cited

OTHER PUBLICATIONS

Daley, Terry; Issue Notification for U.S. Appl. No. 14/703,919, filed May 5, 2015, dated Jul. 11, 2018, 1 pg.
Daley, Terry; Notice of Allowance for U.S. Appl. No. 14/703,919, filed May 5, 2015, dated May 10, 2018, 12 pgs.

* cited by examiner

TRANSPORTABLE HUMIDIFIER

REFERENCE TO RELATED APPLICATIONS

This application is a continuation-in-part of U.S. application Ser. No. 14/703,919, filed May 5, 2015, which claims the benefit of U.S. Provisional Application No. 62/072,197, filed Oct. 29, 2014, both of which are hereby specifically incorporated by reference herein in their entireties.

TECHNICAL FIELD

This disclosure relates to humidifiers. More specifically, this disclosure relates to transportable humidifiers.

BACKGROUND

A room heating and cooling system, such as in hotel rooms, may include a cabinet type enclosure that is installed in individual rooms, such as under a window in a room or installed in a wall. These systems are typically designed as an oblong cabinet having outlet louvers on the top. The outlet louvers may allow hot or cold air generated by the system to exit the louvers and flow into the respective room. These systems often blow dry air into the room and, in many situations, a separate humidifier may not be present in the room.

SUMMARY

Disclosed is a humidifier comprising a container defining a container cavity; a cover positioned over a container opening of the container cavity, the cover defining a body opening and a vent opening, the body opening and the vent opening in fluid communication with the container cavity; an attachment mechanism configured to attach the humidifier to a vent; and a wicking pad mounted in the container cavity between the vent opening and the body opening.

Also disclosed is a system comprising an air conditioning unit, the conditioning unit including a vent bar and a vent opening; and a humidifier defining a container cavity, a body opening, and a vent opening, the body opening and the vent opening in fluid communication with the container cavity, the humidifier comprising an attachment mechanism and a wicking pad, attachment mechanism attaching the humidifier to the vent bar, and wicking pad mounted in the container cavity between the vent opening and the body opening.

Also disclosed is a method comprising placing water into a container of a humidifier;

mounting the humidifier on an air conditioning unit; and humidifying air from the air conditioning unit by directing the air into the container and through a wicking pad mounted in the container.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1:
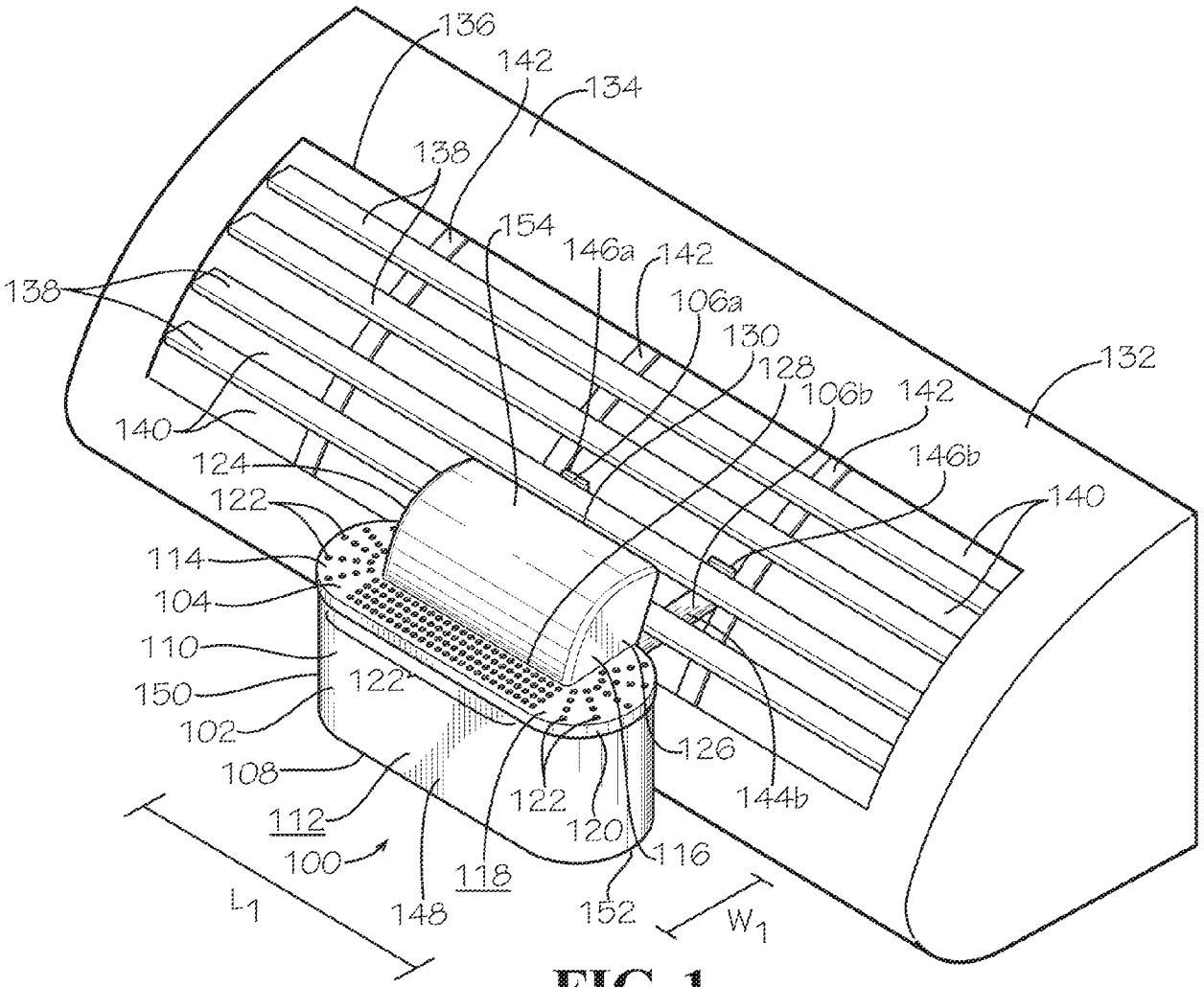
FIG. 1 is a front perspective view of the humidifier, including a container, cover, and support bar, installed on a heating system in accordance with one embodiment of the present disclosure.

The disclosure relates to a transportable humidifier that is placed on a room heating system. The humidifier may also be placed on various other air units or air conditioning units that heat, cool, or provide both heating and cooling. One problem with room heating systems is that the air generated by the system may create a dry air environment in the room with the room heating system. Air with no humidity may be detrimental to the health of any occupants in the room. For example, air with little or no humidity may cause sore throats and coughing.

Many aspects of the human body are reliant at least partially on humidity, which is the amount of water vapor in the air. For example, biological systems such as the respiratory system are reliant on humidity. A low humidity environment may be a contributing factor for various ailments such as dry skin, irritated sinuses, irritated throats, and itchy eyes. For example, over time, exposure to low humidity can dry out and inflame the mucous membrane lining a person's respiratory tract. When this natural barrier is inflamed, the person may be more susceptible to infections such as the common cold or the flu. As another example, low humidity may damage a person's eyes and skin because the moisture balance for a healthy, comfortable eye surface is disrupted and the skin may become dry, scaly, or itchy.

Humidifiers are a devices which increase the level of humidity in an environment. Various buildings such as hotels, schools, nursing homes, residential homes, and other similar buildings commonly have rooms with independent wall registers, which are systems including heating and cooling equipment, for each room in the building. Incorporating humidifiers with the wall registers in each room may be cost-prohibitive to install and further be cost-prohibitive. For example, because humidifiers commonly require moving parts and a power source to operate, incorporating humidifiers may present a great cost to operators from a power and maintenance perspective. There is therefore a need for humidifiers that are energy efficient, affordable, portable, and compatible with standard wall registers.

The present disclosure discloses a transportable humidifier that can easily be transported by a person or traveler to any location where an air venting system, such as a wall register, is located. In various embodiments, this location can be a motel, hotel, or in one's home for example. In various embodiments, the humidifier includes an oblong container having a top cover with a multiple of small holes or openings therein. In the middle of the cover a hood is installed. In various embodiments, the hood has an opening directed toward louvers of the wall register. The hood may have an opening directed toward the louvers of the heater where the hot air is exiting in various embodiments. In various embodiments, a portion of the hot air is moved under pressure into the opening of the hood. The bottom of the oblong container may have a certain amount of water located therein. In various embodiments where hot air is directed into the opening of the hood and thereby into the container with the water therein, the hot air cannot exit at any speed similar to the speed of the air exiting the louvers. In various embodiments, because of the multiple of the small openings in the cover of the container, the water in the bottom of the container starts to swirl and the hot air picks up water molecules, which convert into humidity. Humidified air will exit through the small openings in the cover of the container and thereby carry the humidified air in to the respective room, which changes the air atmosphere to a proper and acceptable level.

Disclosed is a humidifier and associated methods, systems, devices, and various apparatus. The humidifier includes a container, a cover, and a support bar. It would be understood by one of skill in the art that the disclosed humidifier is described in but a few exemplary embodiments among many. No particular terminology or description should be considered limiting on the disclosure or the scope of any claims issuing therefrom. Directional references such as "up," "down," "top," "left," "right," "front," "back," and "corners," among others are intended to refer to the orientation as shown and described in the figure (or figures) to which the components and directions are referencing One embodiment of a humidifier 100 is disclosed and described in FIG. 1. In various embodiments, the humidifier 100 includes a container 102, a cover 104, and support bars 106*a,b*. In the present embodiment, the humidifier 100 includes two support bars 106*a,b*; however, the number of support bars 106*a,b* should not be considered limiting on the current disclosure as in various other embodiments, the humidifier 100 may include any number of support bars 106, including no support bars 106. In various other embodiments, the humidifier 100 may include hooks, straps, or various other attachment mechanisms enabling the humidifier 100 to be attached to an air unit or vent, as described in greater detail below. In various embodiments, the components of the humidifier 100 may be individual components or may be integral with each other.

The container 102 includes a top end 200 (shown in FIG. 2), a bottom end 108, and at least one lateral side wall 110. The lateral side wall 110 includes an outer surface 112 and an inner surface 202 (shown in FIG. 2) extending from the top end 200 to the bottom end 108. At the bottom end 108, the container 102 includes a bottom side wall 1210 (shown in FIG. 12). In various embodiments, the bottom side wall 1210 may be planar, curved, or have any other desired shape. The container 102 defines a container opening 204 (shown in FIG. 2) at the top end 200.

As shown in FIG. 1, in various embodiments, the container 102 of the humidifier 100 is an oblong container with the lateral side wall 110 having rounded corners. In embodiments where the container 102 is oblong, a length $L_1$ of the container 102 is greater than a width $W_1$ of the container 102. In various embodiments, the length $L_1$ of the container 102 is less than a length of a wall register 132 and the width $W_1$ of the container 102 is less than a width of the wall register 132. In the present embodiment, the lateral side wall 110 is a single wall including a front planar segment 148, a back planar segment 206 (shown in FIG. 2), a left rounded segment 150, and a right rounded segment 152. In various embodiments, a distance from the top end 200 to the bottom end 108 may be varied to vary the volume of a container cavity 210 (shown in FIG. 2).

The shape of the container 102 or number of lateral side walls 110 should not be considered limiting on the current disclosure as in various other embodiments, the container 102 may be rectangular, spherical, cylindrical, or any other desired shape, may have multiple side walls, may have a single side wall with multiple segments, or may have any other desired form. For example, in various other embodiments, the container 102 may include a lateral side wall 110 with square ends instead of the rounded segments 150,152. In various other embodiments, the container 102 may include a lateral side wall 110 with angled or pointed ends instead of the rounded segments 150,152. In various other embodiments, the container 102 may include a circular lateral side wall 110. In various other embodiments, for example where the container 102 is spherical or semi-spherical, the container 102 may not have a bottom wall but instead may only have a single side wall. In various other embodiments, the bottom side wall 1210 is curved, angled, or has any other desired shape. In various other embodiments, the container 102 is half-sphere or half-ellipsoid with a curved bottom side wall 1210 and the lateral side wall 110. In various other embodiments, the lateral side wall 110 may be fluted, grooved, or have any other desired shape or design.

As shown in FIG. 1, the humidifier 100 includes the cover 104 attached to the container 102 at the top end 200 (shown in FIG. 2) of the container 102. In various embodiments, the cover 104 may be integral with the container 102 and may be defined as any portion of the container 102 over a max fluid level when the container 102 is filled with a fluid, such as water.

In various embodiments, the cover 104 includes a cover body 114 and a hood 116 mounted thereon. The cover body 114 has a top surface 118 and a bottom surface 600 (shown in FIG. 6). In various embodiments, the hood 116 extends upwards from the top surface 118 of the cover body 114.

As shown in FIG. 1, in various embodiments, the cover 104 includes a flange 120 connected to the cover body 114. In various embodiments, the flange 120 extends axially downwards from the bottom surface 600 of the body 114. As shown in FIG. 1, in various embodiments, the cover 104 includes a plurality of vent openings 122 defined through the cover body 114 from the top surface 118 to the bottom surface 600. As described in greater detail below, the cover body 114 also defines a body opening 300 (shown in FIG. 3) in fluid communication with the hood 116. In various other embodiments, the hood 116 and the vent openings 122 are included on any portion of the container 102 over the max fluid level in the container 102. In various other embodiments, the vent openings 122 are defined in the cover 104 and the hood 116 is integral with or connected to the container 102. In various other embodiments, the vent openings 122 are defined in the container 102 and the hood 116 is integral with or connected to the cover 104. The size, shape, number, or location of the vent openings 122 should not be considered limiting on the current disclosure as in various other embodiments, the vent openings 122 may have any desired size, any desired shape, any desired number, or have any desired location.

The hood 116 includes a left end 124, a right end 126, a bottom end 128, and a top end 130. As shown in FIG. 1, the hood 116 includes a side wall 154 extending between the ends 124,126,128,130. In various embodiments, the side wall 154 is arcuate-shaped; however, the shape of the side wall 154 should not be considered limiting as in various other embodiments, the side wall may be angled, squared, or have any other desired shape. In addition, in various other embodiments, the hood 116 may include more than one side wall 154 extending between the ends 124,126,128,130. As described in greater detail below, the hood 116 defines a hood opening 302 (shown in FIG. 3) at the top end 130. However, in various other embodiments, the hood opening 302 may be defined at any location in the cover 104 or container 102. In various embodiments, the hood opening 302 is any opening that is placed into air flow, such as into air flow from an air conditioning unit, such that air flows through the hood opening 302 and into the container 102. In various embodiments, the air flows through the hood opening 302 and into the container cavity 210, as described in greater detail below.

The hood opening 302 is in fluid communication with the body opening 300 such that a fluid, such as air, may flow into the hood opening 302 and through the body opening 300. In various embodiments, the cover body 114 and hood 116 of the cover 104 are integrally formed; however, in various other embodiments, the hood 116 is connectable to the cover body 114 with an attachment mechanism such as adhesives, snaps, hooks, pins, fasteners, screws, or various other attachment mechanisms for form the cover 104.

As shown in FIG. 1, the humidifier 100 is attached to a front of a wall register 132 by way of the support bars 106*a,b*. The support bars 106*a,b* include a bar body 144*a,b* (144*a* shown in FIG. 3), front upstanding lugs 146*a,b* and back upstanding lugs 304*a,b* (shown in FIG. 3) at the respective ends of the bar body 144*a,b* of the support bars 106*a,b*. In various embodiments, the front upstanding lugs 146*a,b* and the back upstanding lugs 304*a,b* retain the container 102 of the humidifier 100 on vent bars, such as louver bars 138, of the wall register 132, as described in greater detail below. The shape or design of the support bars 106*a,b* should not be considered limiting on the current disclosure as in various other embodiments, the support bars 106*a,b* may have any desired shape or design suitable for connecting the humidifier 100 to the wall register 132. For example, in various other embodiments, the support bars 106*a,b* may be rounded, have curved edges, be angled, or have any other desired shape or design. In various other embodiments, other connection mechanisms such as hooks, straps, pins, or various other connecting mechanisms may be utilized instead of the support bars 106*a,b*.

Figure 3:
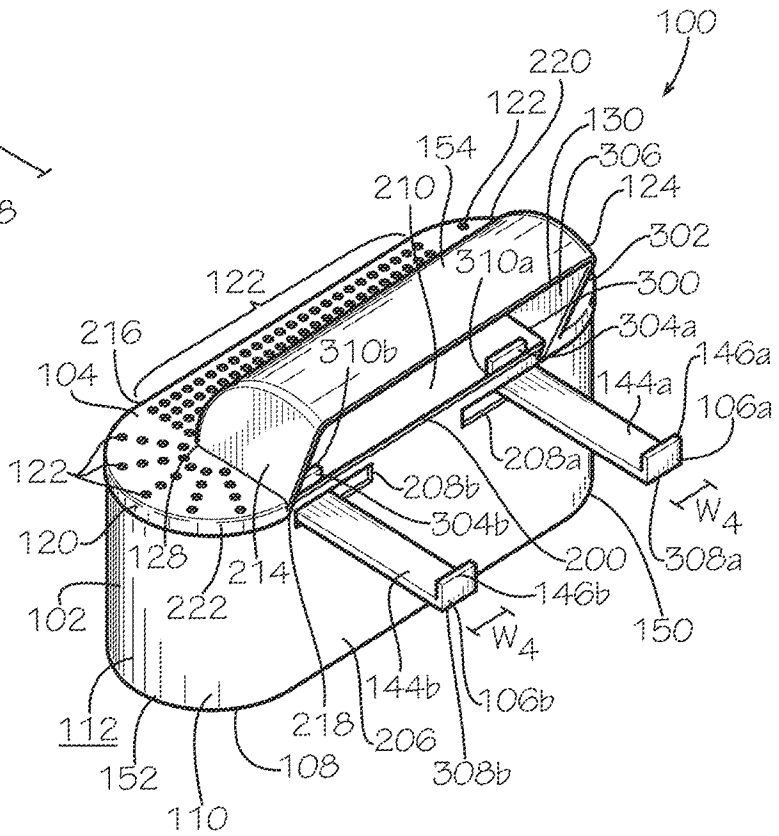
FIG. 3 is a back perspective view of the humidifier of FIG. 1.

FIG. 1 shows the humidifier 100 mounted to a standard wall register 132 typically found in hotel rooms, classrooms, hospital rooms, and various other rooms with independent heating and cooling units. The wall register 132 includes an enclosure 134 having an opening 136 in various embodiments. The enclosure 134 may include the louver bars 138 which create louver openings 140 or other vent openings. The louver bars 138 may be supported on vertical support bars 142 of the enclosure 134 in various embodiments. In various other embodiments, the louver bars 138 and vertical support bars 142 are components of a grate insertable in the opening 136 of the enclosure 134. Air generated by the wall register 132, such as hot air, is emitted by the wall register 132 through the louver openings 140 and into the respective environment, such as a room to be heated. The disclosure of the wall register 132 should not be considered limiting on the current disclosure as in various other embodiments, any design, shape, or type of wall register 132 may be utilized. In various other embodiments, the humidifier 100 may be mounted on various other objects or units such as wall vents, ceiling vents, vents connected to a central air conditioning unit, fans, or various other air system components. As described above, in various embodiments, the humidifier 100 may include an attachment mechanism to attach the humidifier 100 to the wall register 132 or various other objects or units. In the present embodiment, the attachment mechanism is the support bars 106*a,b*; however, in various other embodiments, the attachment mechanism may be hooks, straps, or various other attachment mechanisms suitable for attaching the humidifier 100 to the wall register 132 or various other objects or units As previously described, in various embodiments, the container 102 is attached to the louver bars 138 by way of support bars 106*a,b* on the wall register 132. In the present embodiment, there are two support bars 106*a,b*. In the present embodiment, each of the support bars 106*a,b* includes the front upstanding lugs 146*a,b* and the back upstanding lugs 304*a,b* (shown in FIG. 3). As shown in FIG. 1, in various embodiments, the front upstanding lugs 146*a,b* engage the wall register 132 and hook on to the louver bars 138. As shown in FIG. 3, the back upstanding lugs 304*a,b* engage the container 102. In various embodiments, the back upstanding lugs 304*a,b* may be inserted into support openings 208*a,b* (shown in FIG. 2) of the container 102 to engage the container 102.

Figure 2:
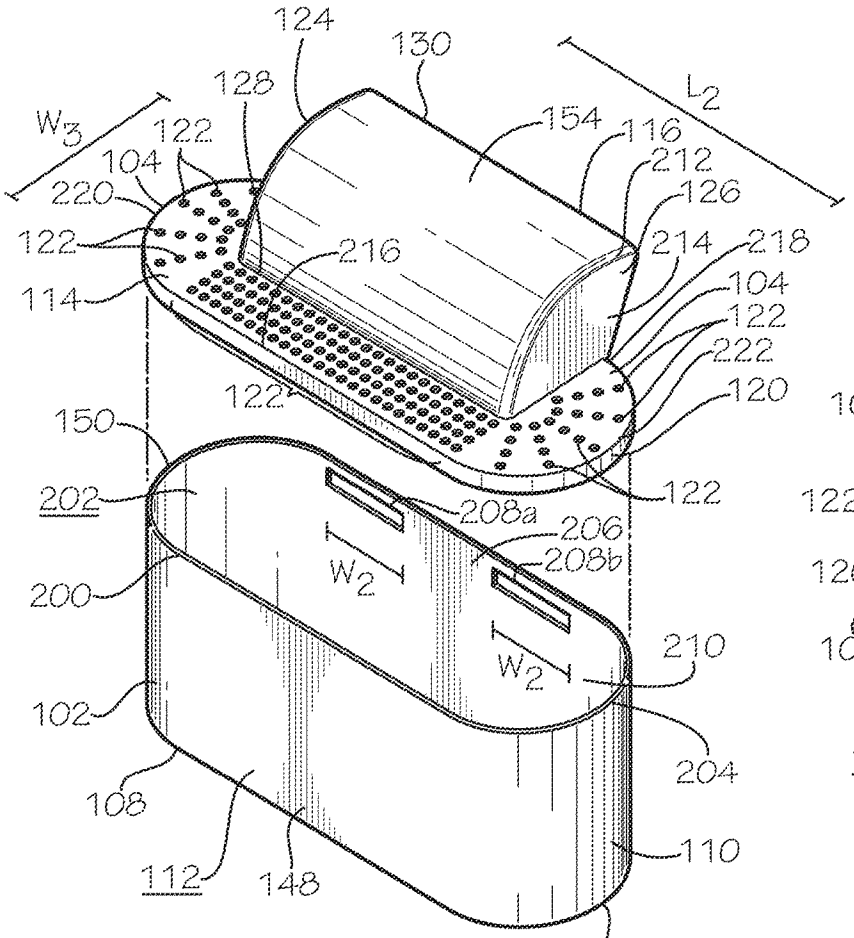
FIG. 2 is an exploded view of the container and cover of the humidifier of FIG. 1.

FIG. 2 shows the cover 104 removed from the container 102. As shown in FIG. 2, the container 102 includes the top end 200 and the bottom end 108. In various embodiments, the container 102 includes the lateral side wall 110 having the outer surface 112 and the inner surface 202. In various embodiments, the inner surface 202 of the lateral side wall 110 and an inner surface 1212 (shown in FIG. 12) of the bottom side wall 1210 (shown in FIG. 12) define the container cavity 210. At the top end 200, the container 102 defines the container opening 204. In various embodiments, the container opening 204 provides access to the container cavity 210 such that a fluid, such as water or air, may flow into the container cavity 210.

As shown in FIG. 2, in various embodiments, the container 102 defines the support openings 208*a,b*. In the present embodiment, the container 102 defines two support openings 208*a,b*. However, the number of support openings 208*a,b* should not be considered limiting on the current disclosure as in various other embodiments, the container 102 may define any desired number of support openings 208*a,b*, including no support openings 208*a,b* in various embodiments. In the present embodiment, the support openings 208*a,b* define a generally rectangular slot shape; however, the shape of the support openings 208*a,b* should not be considered limiting on the current disclosure as in various other embodiments, the support openings 208*a,b* may have any desired shape.

The support openings 208*a,b* extend through the lateral side wall 110 from the inner surface 202 to the outer surface 112 of the lateral side wall 110. In the present embodiment, the support openings 208*a,b* are defined on the back planar segment 206 of the lateral side wall 110 proximate to the top end 200 of the container 102. However, the location of the support openings 208*a,b* on the container 102 should not be considered limiting on the current disclosure as in various other embodiments, the support openings 208*a,b* may be defined at any desired location on the container 102. As shown in FIG. 2, in various embodiments, each of the support openings 208*a,b* has a width $W_2$.

As described in greater detail below with reference to FIG. 3, in various embodiments, the support bars 106*a,b* engage the container 102 such that second ends 310*a,b* of the support bars 106*a,b* will penetrate and extend through the support openings 208*a,b* with the back upstanding lugs 304*a,b* holding the container 102 on the support bars 106*a,b* and in a proper attitude once the support bars 106*a,b* are attached to the wall register 132.

As shown in FIG. 2, the cover 104 includes the cover body 114 and the hood 116. In various embodiments, the cover 104 also includes the flange 120 extending axially downwards from the cover body 114. The cover body 114 has the top surface 118 and the bottom surface 600 (shown in FIG. 6). As shown in FIG. 2, in various embodiments, the plurality of vent openings 122 are defined in the cover body 114 extending from the top surface 118 to the bottom surface 600. In the present embodiment, the vent openings 122 have a circular shape. As shown in FIG. 2, in the present embodiment, some of the vent openings 122 are arranged in a series of rows and columns and others of the vent openings 122 are arranged in a radial pattern. The shape, number, or location of the vent openings 122 on the cover body 114 should not be considered limiting on the current disclosure as in various other embodiments, the cover 104 may include any desired number, shape, or location of the vent openings 122.

In various embodiments, the shape of the cover body 114 is complimentary to the shape of the container 102. In the present embodiment, the cover body 114 includes a front linear side 216, a back linear side 218, a left rounded side 220, and a right rounded side 222. In the present embodiment, the cover body 114 is an oblong shape such that a width $W_3$ of the cover body 114 is less than a length $L_2$ of the cover body 114. In various embodiments, the width $W_3$ of the cover body 114 is greater than the width $W_1$ of the container 102 and the length $L_2$ of the cover body 114 is greater than the length $L_1$ of the container 102. In these embodiments, the greater width $W_3$ and length $L_2$ dimensions of the cover body 114 relative to those of the container 102 enable the flange 120 to cover at least a part of the outer surface 206 of the lateral side wall 110 when the cover 104 is positioned on the container 102. The shape of the cover body 114 should not be considered limiting on the current disclosure as in various other embodiments, the cover body 114 may have any desired shape that may or may not be complimentary to the shape of the container 102. For example, in various other embodiments, the cover body 114 may include square sides instead of the rounded sides 220,222. In various other embodiments, the cover body 114 may include angled or pointed sides instead of the sides 220,222. In various other embodiments, the cover body 114 may be circular with a circular side. In various other embodiments, the cover body 114 may be rounded or semi-spherical or have any other desired shape.

As shown in FIG. 2, in various embodiments, the hood 116 is connected to the cover body 114 in a position to leave the plurality of vent openings 122 unobstructed and free to allow humidified air to exit through the openings 122. As previously described, the hood 116 includes the left end 124, the right end 126, the bottom end 128, and the top end 130. In various embodiments, the hood 116 has a left lateral side wall 306 (shown in FIG. 3) at the left end 124 and a right lateral side wall 214 at the right end 126. The hood 116 includes the side wall 154 extending between the ends 124,126,128,130. In various embodiments, the side wall 154 is an arcuate-shaped side wall 154. As shown in FIG. 2, in various embodiments, a first tapered surface 212 connects the right lateral side wall 214 with the side wall 154. In various embodiments, a second tapered surface 500 (shown in FIG. 5) connects the left lateral side wall 306 with the side wall 154.

FIG. 3 shows the humidifier 100 assembled and ready to be attached to the wall register 132. As shown in FIG. 3, the cover 104 is positioned on the container 102 such that the flange 120 covers at least a part of the outer surface 112 of the lateral side wall 110. As shown in FIG. 3, the cover 104 includes the vent openings 122 defined in the cover body 114. The cover body 114 also defines the body opening 300 in various embodiments.

FIG. 3 also shows the upstanding hood 116 of the cover 104 having the right lateral side wall 214, the left lateral side wall 306, and the side wall 154. In various embodiments, the top end 130 of the hood 116 extends beyond the back planar segment 206 of the lateral side wall 110 such that the top end 130 is not coplanar with the lateral side wall 110 along a vertical axis of the humidifier 100. In various other embodiments, the top end 130 is coplanar with the lateral side wall 110 at the back planar segment 206 along the vertical axis of the humidifier 100. In various embodiments, the top end 130 of the hood 116 extends beyond the back linear side 218 of the cover body 114 such that the top end 130 is not coplanar with the back linear side 218 along the vertical axis of the humidifier 100. In various other embodiments, the top end 130 may be coplanar with the back linear side 218 along the vertical axis of the humidifier 100. As shown in FIG. 3, in various embodiments, the side walls 154,214,306 define the hood opening 302. In various embodiments, the hood opening 302 provides access to the container cavity 210 when the cover 104 is positioned on the container 102. In this manner, fluid flow, for example fluid flow of air, is enabled through the hood opening 302, into the hood 116, through the body opening 300, and into the container cavity 210 of the container 102.

As shown in FIG. 3, in various embodiments, the cover 104 is positioned on the container 102 such that the hood opening 302 is on the same side of the humidifier 100 as the support openings 208*a,b*. In various embodiments, when the humidifier 100 is mounted on the wall register 132, the hood opening 302 faces the louver openings 140. In various other embodiments, the humidifier 100 is mounted on other air conditioning units including various grates, room vents, or various other components of the various units. In various embodiments, the hood opening 302 may be positioned in a very close relationship with the louver openings 140 or proximate to the louver openings 140 such that a distance between the hood opening 302 and louver openings 140 is minimized. In various embodiments, air exiting from the wall register 132 through the louver openings 140 may be forced into the container 102 through the hood opening 302 in the hood 116.

FIG. 3 also shows the support bars 106*a,b* engaged with the container 102. As shown in FIG. 3, in various embodiments, the support bars 106*a,b* are inserted into the support openings 208*a,b* to engage the container 102. In various embodiments, the respective support bars 106*a,b* have a first end 308*a,b* and a second end 310*a,b*. In various embodiments, the support bars 106*a,b* include the back upstanding lugs 304*a,b* at the second end 310*a,b* and the front upstanding lugs 146*a,b* at the first end 308*a,b*. In various embodiments, each support bar 106*a,b* has a width $W_4$. In various embodiments, the width $W_4$ of each support bar 106*a,b* is less than the width $W_2$ of each support opening 208*a,b*. In these embodiments, the support bars 106*a,b* may be movably positioned in the respective support openings 208*a,b* to position the support bars 106*a,b* relative to the humidifier 100 as desired in the support openings 208*a,b*. In various embodiments, the support bars 106*a,b* are movably positioned in the support openings 208*a,b* by sliding the support bars 106*a,b* along the width of the support openings 208*a,b*. In various embodiments, the back upstanding lugs 304*a,b* hook into the container 102 through the support openings 208*a,b* such that the support bars 106*a,b* may be retained on the container 102. In various embodiments, the back upstanding lugs 304*a,b* are at least partially positioned in the container cavity 210. In various embodiments, the front upstanding lugs 120*a,b* hook under the louver bars 140 to maintain the container 102 and thereby the humidifier 100 in close proximity to the wall register 132.

In various embodiments, the support bars 106*a,b* also enable the container 102 to be movably positioned on the bar body 144*a,b* of each support bar 106*a,b* between the first end 308*a,b* and the second end 310*a,b* of each support bar 106*a,b*. In various embodiments, the container 102 is slidable on the bar body 144*a,b* between the front upstanding lugs 146*a,b* and the back upstanding lugs 304*a,b*. In various embodiments, the movement of the container 102 along the bar body 144*a,b* of each support bar 106*a,b* allows a user to vary a distance between the hood opening 302 of the humidifier 100 and the louver openings 140 when the humidifier is mounted on the wall register 132. By varying the distance between the hood opening 302 and the louver openings 140, the user may control how much of the air exiting the louver openings 140 is forced into the hood opening 302 and thereby into the humidifier 100.

Figure 4:
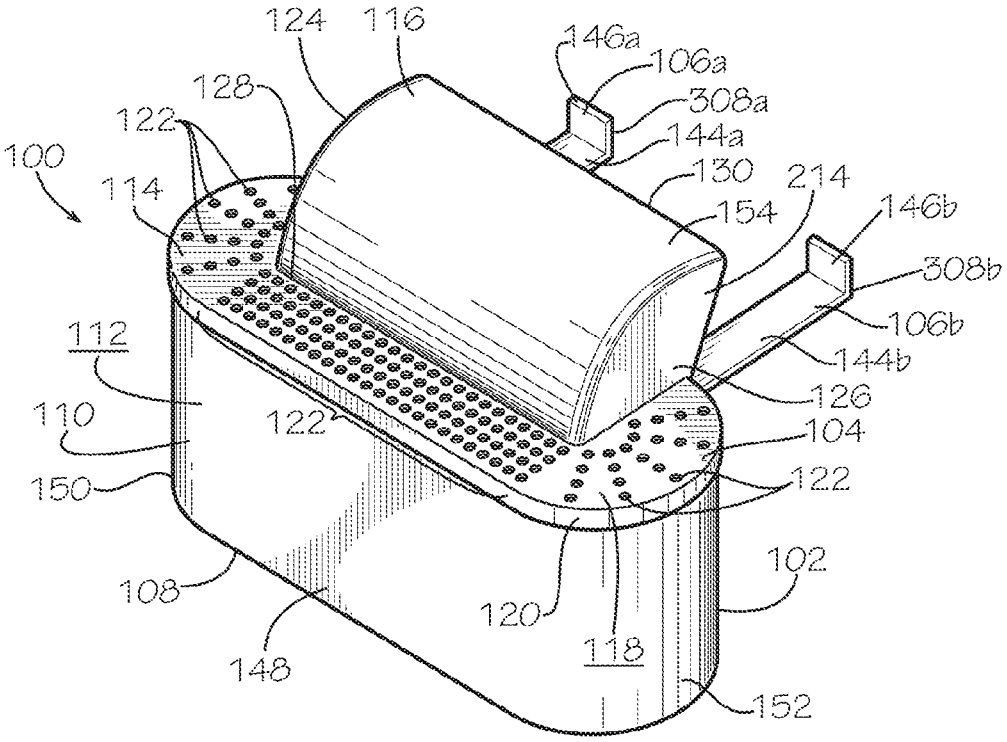
FIG. 4 is another front perspective view of the humidifier of FIG. 1.

FIG. 4 is another perspective view of the assembled humidifier 100. The container 102 is shown having the cover 104 attached thereon. In various embodiments, the cover 104 rests on the container 102 without any securing mechanism. In various embodiments, the bottom surface 600 (shown in FIG. 6) rests on the top side 200 of the container 102. The flange 120 may help position the cover 104 on the container 102 and retain the cover 104 on the container 102. In various other embodiments, the cover 104 is secured to the container 102 through a securing mechanism such as hooks, snaps, clasps, buckles, pins, or various other securing mechanisms for securing the cover 104 to the container 102.

The cover 104 again shows the vent openings 122 defined in the cover body 114. The hood 116 is connected with the cover body 114. The support bars 106*a,b* are connected to the container 102 through the support openings 208*a,b* shown previously in FIGS. 2 and 3. The support bars 106*a,b* have the front upstanding lugs 146*a,b* and the back upstanding lugs 304*a,b* which may be utilized to hold the container 102, and thereby the humidifier 100, in close proximity to the louver openings 140.

Figure 5:
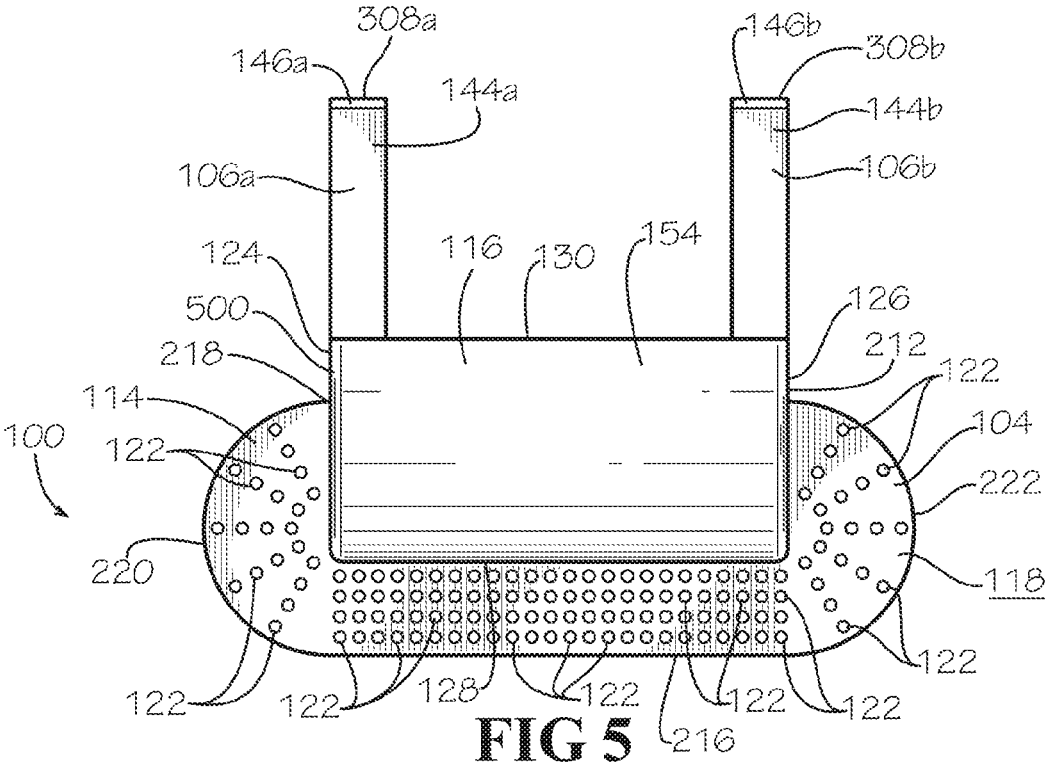
FIG. 5 is a top view of the humidifier of FIG. 1.

FIG. 5 shows a top view of the assembled humidifier 100. As previously described, in various embodiments, the hood 116 includes the second tapered surface 500, which connects the left lateral side wall 306 with the side wall 154. As shown in FIG. 5, in various embodiments, the top end 130 extends beyond the back linear side 218 of the cover body 114 such that the top end 130 is not coplanar with the back linear side 218 along the vertical axis of the humidifier 100. In various other embodiments, the top end 130 is coplanar with the back linear side 218 along the vertical axis of the humidifier 100.

As shown in FIG. 5, in various embodiments, the vent openings 122 defined in the cover body 114 between the hood 116 and the front linear side 216 are arranged in a series of rows and columns. In various embodiments, the vent openings 122 defined in the cover body 114 between the hood 116 and the right rounded side 222 are arranged in a radial pattern. In various embodiments, the vent openings 122 defined in the cover body 114 between the hood 116 and the left rounded side 220 are also arranged in a radial pattern. The disclosure of the arrangement, pattern, number, or shape of the vent openings 122 should not be considered limiting on the current disclosure.

Figure 6:
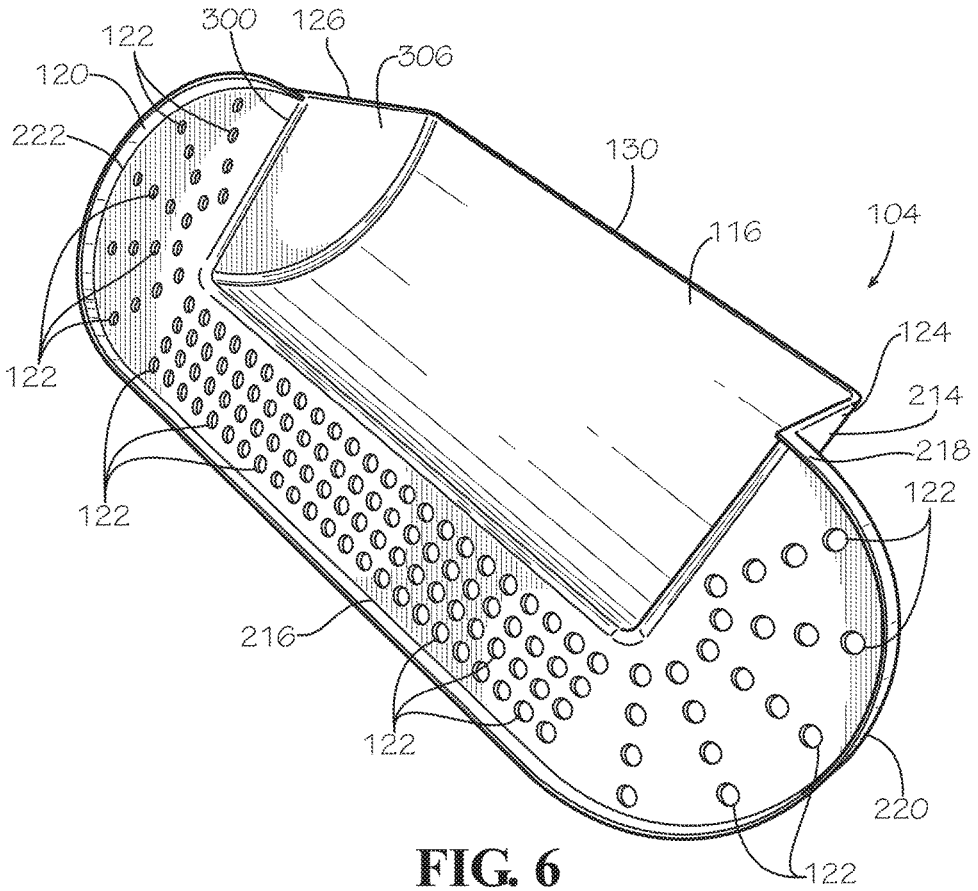
FIG. 6 is a bottom view of the cover of the humidifier of FIG. 1.

FIG. 6 shows a bottom view of the cover 104. As shown in FIG. 6, the cover body 114 includes a bottom surface 600. The flange 120 extends axially downwards from the bottom surface 600 in various embodiments. The vent openings 122 are defined in the bottom surface 600 of the cover body 114.

Figure 7:
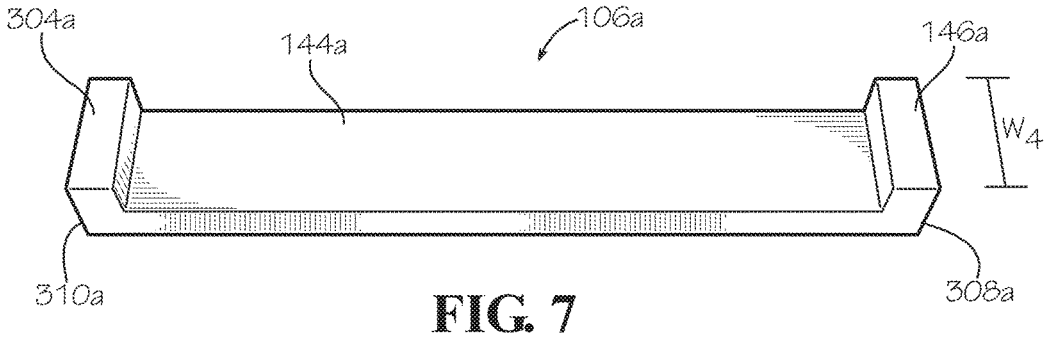
FIG. 7 is a perspective view of a support bar of the humidifier of FIG. 1.

FIG. 7 shows the support bar 106*a*. Although reference is made to support bar 106*a*, the below discussion is equally applicable to support bar 106*b* respectively. The support bar 106*a* includes the bar body 144*a* having the first end 308*a* and the second end 310*a*. At the first end 308*a*, the support bar 106*a* includes the front upstanding lug 146*a*. At the second end 310*a*, the support bar 106*a* includes the back upstanding lug 304*a*. When the support bar 106*a* is inserted through the support opening 208*a* of the container 102, the lugs 146*a*,304*a* retain the support bar 106*a* within the support opening 208*a*. The container 102 is slidable on the bar body 144*a* between the front upstanding lug 146*a* and the back upstanding lug 304*a*.

A method of using the humidifier 100 is also disclosed. It should be noted that any of the steps of any of the methods described herein may be performed in any order or could be performed in sub-steps that are done in any order or that are separated in time from each other by other steps or sub-steps, and the disclosure of a particular order of steps should not be considered limiting on the current disclosure. The humidifier 100 includes the container 102, the cover 104, and support bars 106*a,b*.

The cover 104 is positioned on the container 102. The cover 104 includes the cover body 114 and the hood 116. The cover 104 may include the flange 120 to align position the cover 104 on the container 102. The cover body 114 defines a plurality of vent openings 122 and a body opening 300 in various embodiments. The hood 116 defines a hood opening 302 in various embodiments. The hood opening 302 is in fluid communication with the body opening 300. The container 102 defines the container cavity 210 having the container opening 204. The container opening 204 is in fluid communication with the body opening 300 such that a fluid may flow into the hood opening 302, through the hood 116, through the base opening 300, and into the container cavity 210. Support bars 106*a,b* are positioned in support openings 208*a,b* defined in the side wall 110 of the container 102. The container 102 is slidable along the bar body 144*a,b* of each support bar 106*a,b* between the front upstanding lugs 146*a,b* and the back upstanding lugs 304*a,b*.

The container cavity 210 is filled with a fluid, such as water. The container cavity 210 may be filled with fluid before positioning the cover 104 on the container 102 or after positioning the cover 104 on the container 102 as desired by the user.

The humidifier 100 is mounted on the wall register 132 by inserting the support bars 106*a,b* into louver openings 140 of the wall register 132 such that the front upstanding lugs 146*a,b* hook the louver bars 138. In various embodiments, the support bars 106*a,b* are also positioned in the support openings 208*a,b* such that the support bars 106*a,b* are positioned in the louver openings 140 adjacent to the vertical support bars 142. In various embodiments, positioning the support bars 106*a,b* adjacent to the vertical support bars 142 while the front upstanding lugs 146*a,b* hook the louver bars 138 may give the humidifier 100 additional support. In various embodiments, the back upstanding lugs 304*a,b* retain the support bars 106*a,b*, and thereby the humidifier 100, on the louver bars 138 of the wall register 132. The support bars 106*a,b* are movably positioned in the louver openings 140 to install and position the humidifier 100 in a desired operating position. In various embodiments, the humidifier 100 is positioned to maximize efficiency of the humidifier 100 by positioning the hood opening 302 proximate to the louver openings 140.

The wall register 132 is turned on and air, such as hot air, emanates from the louver openings 140. Some of the air may be forced into the hood opening 302 of the hood 116. The air flows through the hood opening 302, through the hood 116, through the body opening 300, and into the container cavity 210. As previously described, the container 102 has water located in the container cavity 210 in various embodiments. The air forced into the hood 116 and container cavity 210 cannot exit at the force it is being inserted and will swirl around inside the container cavity 210. As the air swirls in the container cavity 210, the air may pick up water molecules from the water in the container 102 and convert it to air with increased levels of humidity. This humidified air may exit the container cavity 210 through the vent openings 122 in the cover 104.

The humidifier 100, then, is an effective way to provide and vent air with increased humidity levels into a respective room and make the atmosphere in the room into a comfortable condition for an occupant. The humidifier 100 has a simple construction with no moving parts. The humidifier 100 itself also does not use electricity and can easily be installed and removed. The humidifier 100 may have a small size, the system can easily be packaged and taken to a different location where it is needed. The humidifier 100 may therefore be energy efficient, eco-friendly, green and sustainable, cordless, noise-free, compact, lightweight, have a low cost of production, easy to install, easy to maintain, and compatible with standard wall registers 132.

Figure 8:
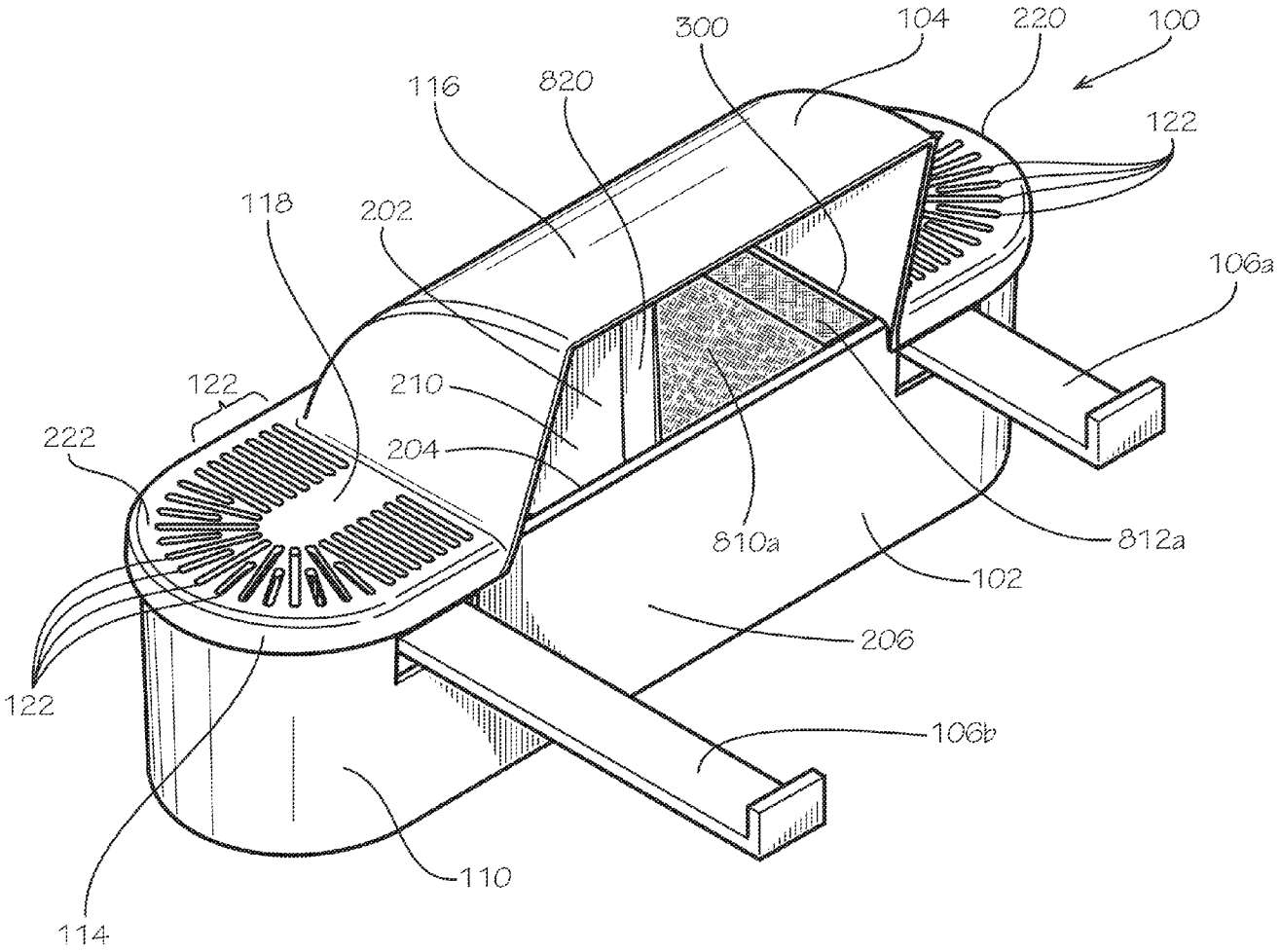
FIG. 8 is a perspective view of a humidifier according to another embodiment of the present disclosure.
Figure 9:
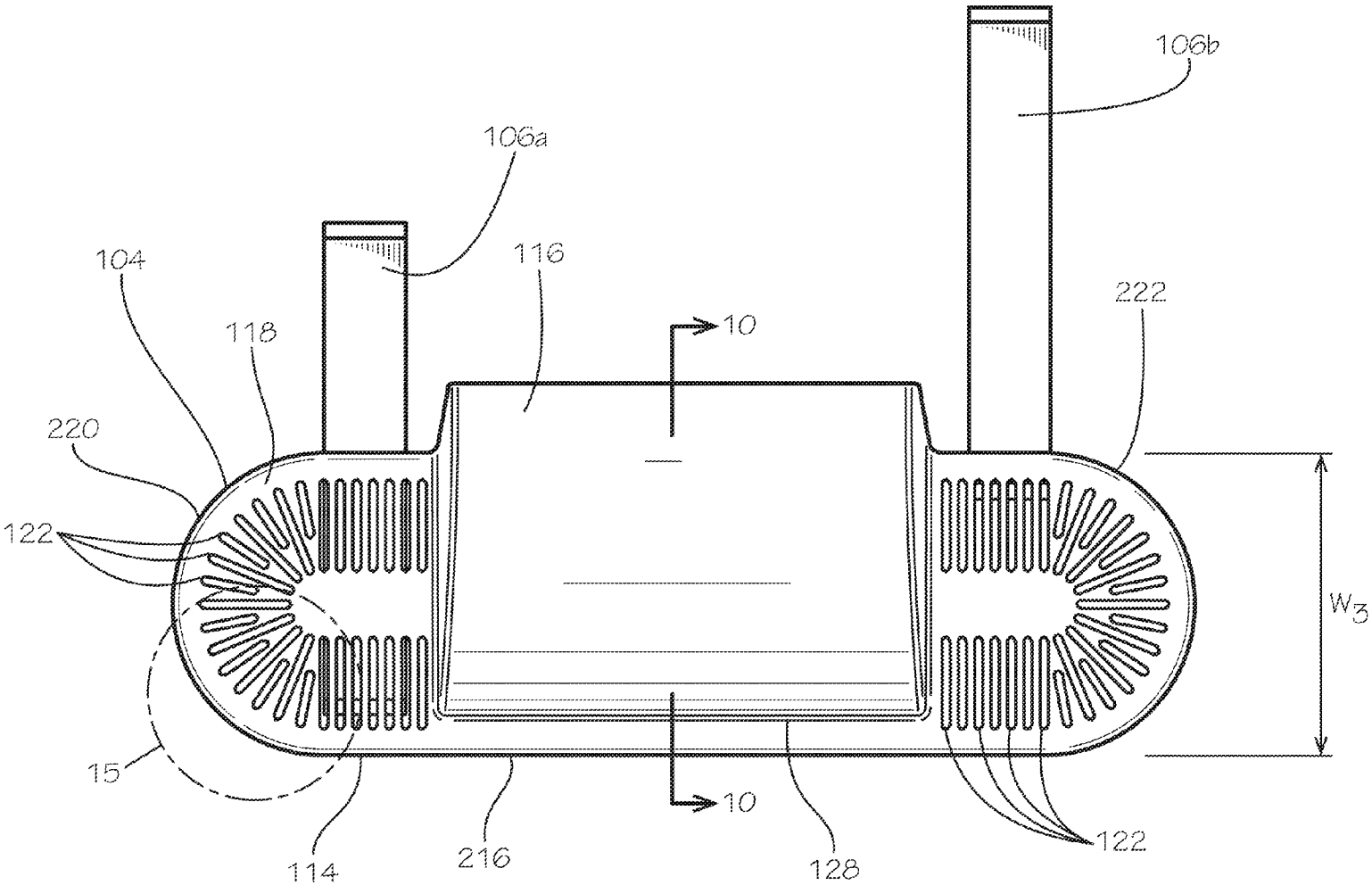
FIG. 9 if a top view of the humidifier of FIG. 8.
Figure 13:
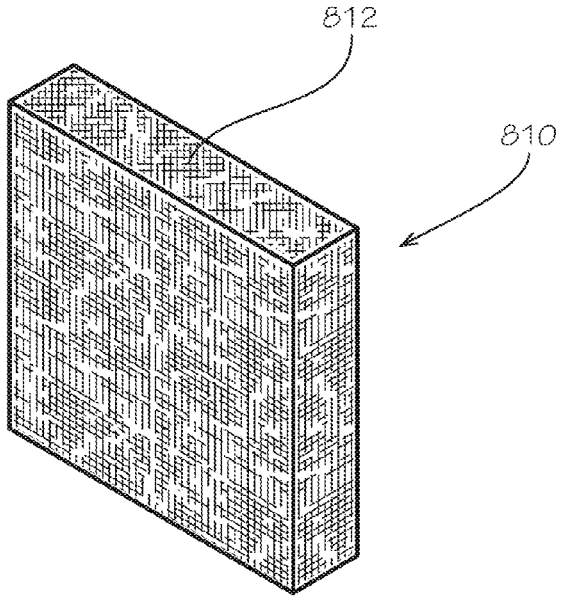
FIG. 13 is a perspective view of a wicking panel of the humidifier of FIG. 8.
Figure 14:
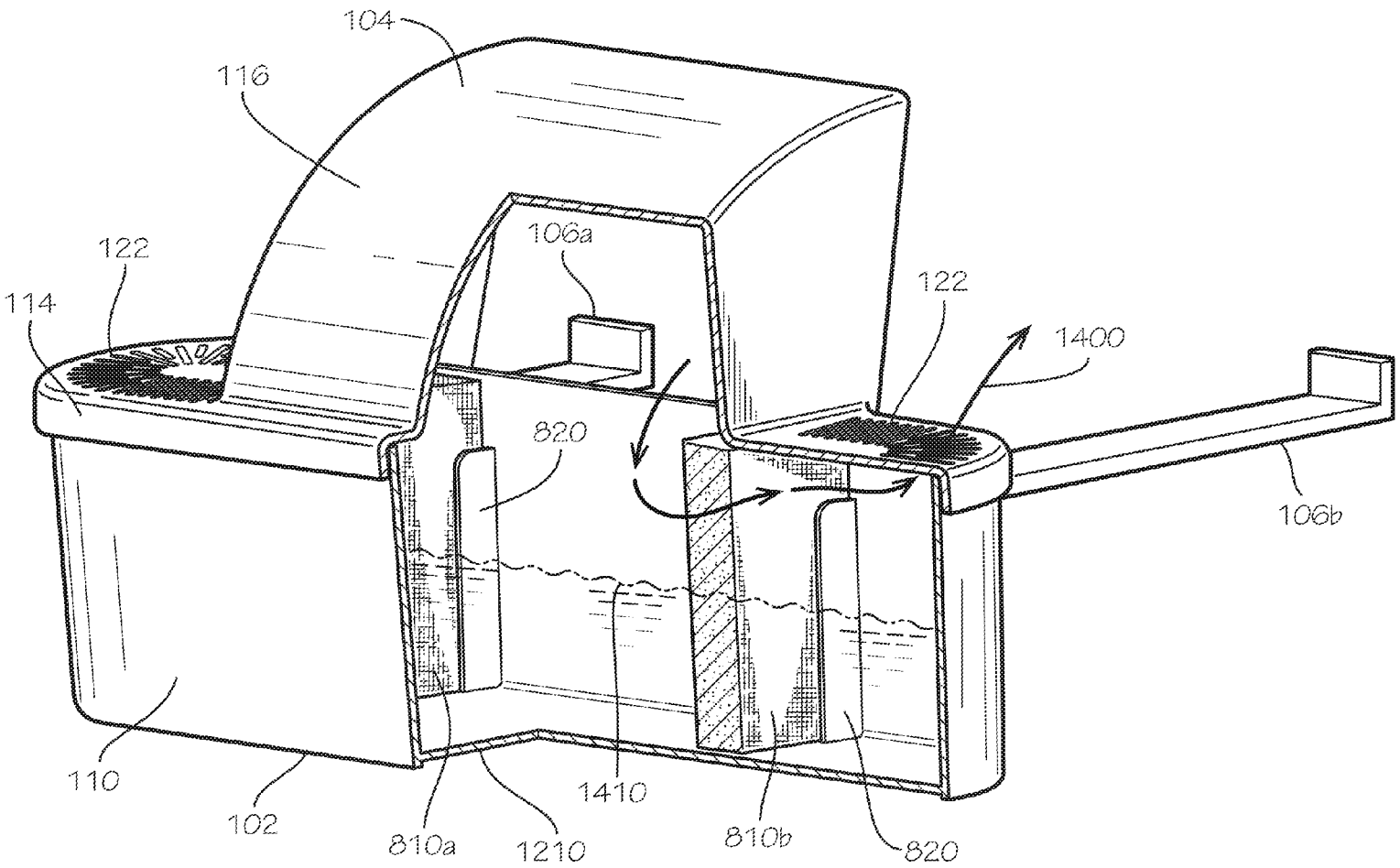
FIG. 14 is a perspective cutaway view of the humidifier of FIG. 8 showing an interior of the humidifier.
Figure 15:
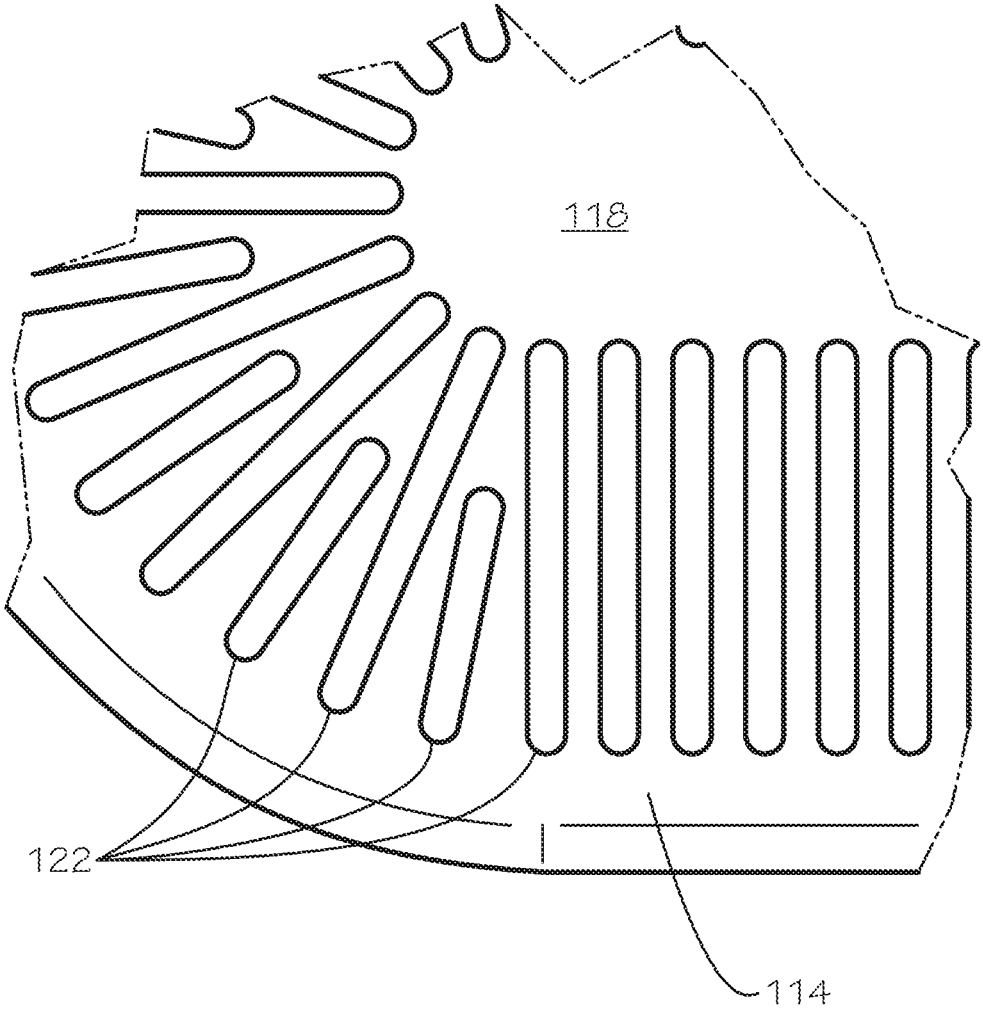
FIG. 15 is a detail view of a cover of the humidifier of FIG. 8 taken from detail 15 in FIG. 9.

FIGS. 8-14 another embodiment of the humidifier 100. The support bars 106*a,b* shown in FIG. 8 are substantially similar to the support bars of the humidifier 100 of FIG. 1 and are simply shown at two different positions with respect to each other and the rest of the humidifier 100 for illustrative purposes. As shown in FIGS. 8 and 9, the cover 104 can comprise the cover body 114 and the hood 116, and the cover body 114 can define the plurality of vent openings 122 defined through the cover body 11 from the top surface 118 to the bottom surface 600. The hood 116 can extend farther across the width $W_3$ of the cover body 114 than shown in FIG. 1 such that no vent openings 122 are defined between the bottom end 128 of the hood 116 and the front linear side 216 of the cover body 114, thereby increasing the size of the body opening 300 and consequently increasing air flow into the humidifier 100. Additionally, the vent openings 122 can be slot-shaped and can be arranged in two U-shaped rows extending along each of the left rounded side 220 and the right rounded side 220. As shown in FIG. 15, the vent openings 122 can define slots of varying lengths.

The humidifier 100 can also comprise a pair of wicking pads 810*a,b* (810*b* shown in FIG. 10) mounted in the container cavity 210 of the container 102. The wicking pads 810*a,b* can be mounted in an upright orientation within the container cavity 210 and can be mounted proximate to opposite sides of the body opening 300 such that the wicking pads 810*a,b* separate the body opening 300 from the vent openings 122 at the rounded sides 220,222 of the cover body 114. Top ends 812*a,b* (812*b* shown in FIG. 11) can be aligned flush with the body opening 300. Further, as shown in FIG. 10, the wicking pads 810*a,b*, when positioned in the upright orientation, can be sized to define a height matching a depth of the container cavity 210 such that the wicking pads 810*a,b* extend from the bottom side wall 1210 to the body opening 300 and can contact the cover body 114, as shown in FIG. 11.

Figure 11:
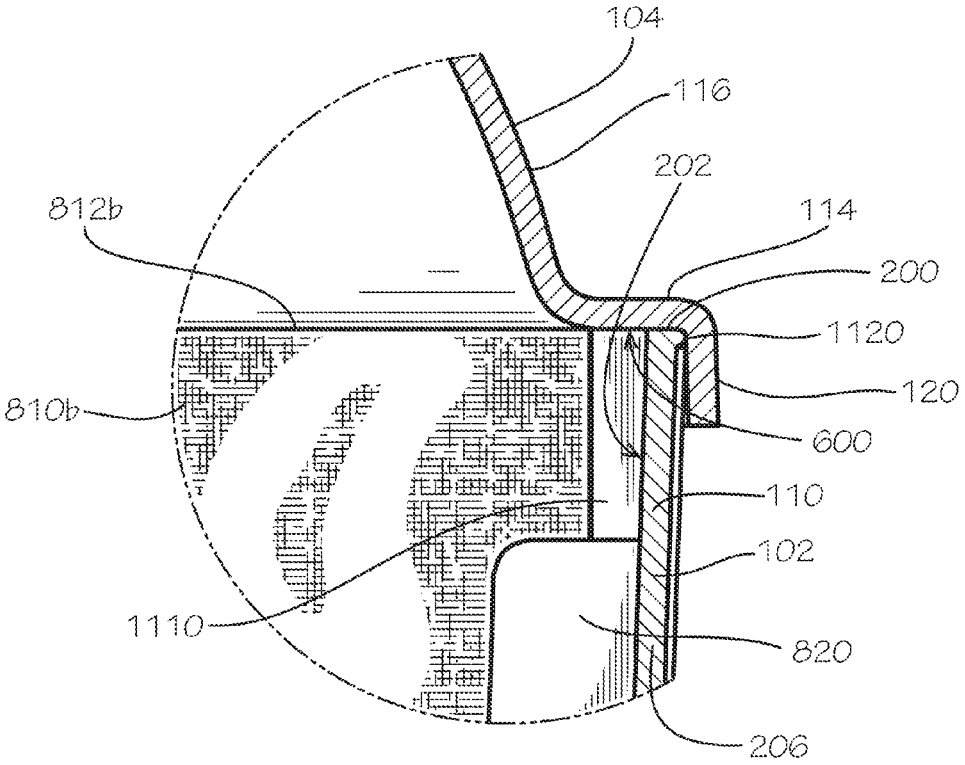
FIG. 11 is a detail view of the humidifier of FIG. 8 taken from detail 11 in FIG. 10.
Figure 12:
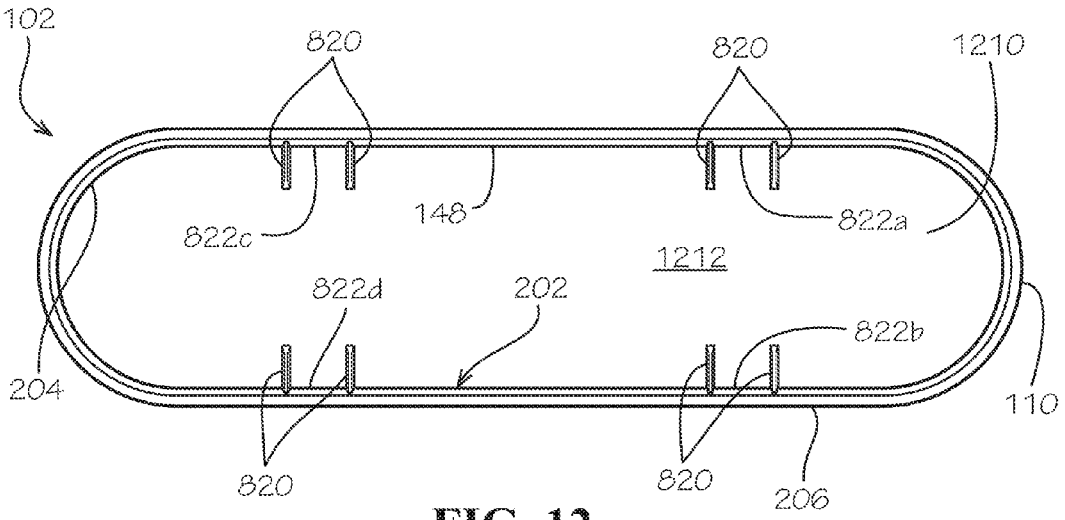
FIG. 12 is a top view of a container of the humidifier of FIG. 8.

The wicking pads 810*a,b* can be held upright by a plurality of mounting flanges 820 extending inwardly into the container cavity 210 from the inner surface 202 of the lateral side walls 110 of the container 102. A portion of each wicking pad 810*a,b*, when in an upright position, can thereby extend above a water level 1410 (shown in FIG. 14) within the container cavity 210. As shown in FIG. 12, the mounting flanges 820 can be defined in the front planar segment 148 and the back planar segment 206. The mounting flanges 820 can define mounting channels 822*a,b,c,d* (shown in FIG. 12), which can be sized to receive the wicking pads 810*a,b* by sliding the wicking pads 810*a,b* into the mounting channels 822*a,b,c,d* through the container opening 204 so that the wicking pads 810*a,b* rest on the inner surface 1212 of the bottom side wall 1210 of the container 102, as shown in FIG. 10. Additionally, the wicking pads 810*a,b* and mounting flanges 820 that are defined in the back planar segment 206 can be sized to define a pair of air gaps 1110 (shown in FIG. 11), respectively, between the wicking pads 810*a,b*, the back planar segment 206, the cover body 114, and the mounting flanges 820 defined in the back planar segment 206.

The wicking pads 810*a,b* can comprise a wicking material that is configured to absorb water within the container cavity 210 and "wick" the water upwards within the wicking pads 810*a,b* to hold a portion of the water above the water level 1410 (shown in FIG. 14) within the container cavity 210. As a result and as shown in FIG. 14, because the wicking pads 810*a,b* are mounted between the body opening 300 and the vent openings 122 and because there are no vent openings 122 defined in the cover body 114 between the wicking pads 810*a,b*, air from the air conditioning unit is forced through the wicking pads 810*a,b* when air flows through the humidifier 100, thereby defining an air flow path 1400 and transferring moisture to the air before it exits the vent openings 122. A portion of the air flow can travel through the pair of air gaps 1110 to ensure some level of air flow out of the humidifier 100 even if the wicking pads 810*a,b* become clogged or otherwise unable to pass air therethrough. The wicking pads 810*a,b* can comprise wicking material such as, for example and without limitation, woven mesh paper, cotton, or foam or non-foam plastic, and can be mold-resistant or mold-free. As shown in FIG. 13, the wicking pads 810*a,b* can define square prisms, though other the wicking pads 810*a,b* can define any other desirable shape in other embodiments, including any shape configured to wick moisture above the water level 1400 and force air flow from the body opening 300 through the wicking pads 810*a,b* to the vent openings 122.

Figure 10:
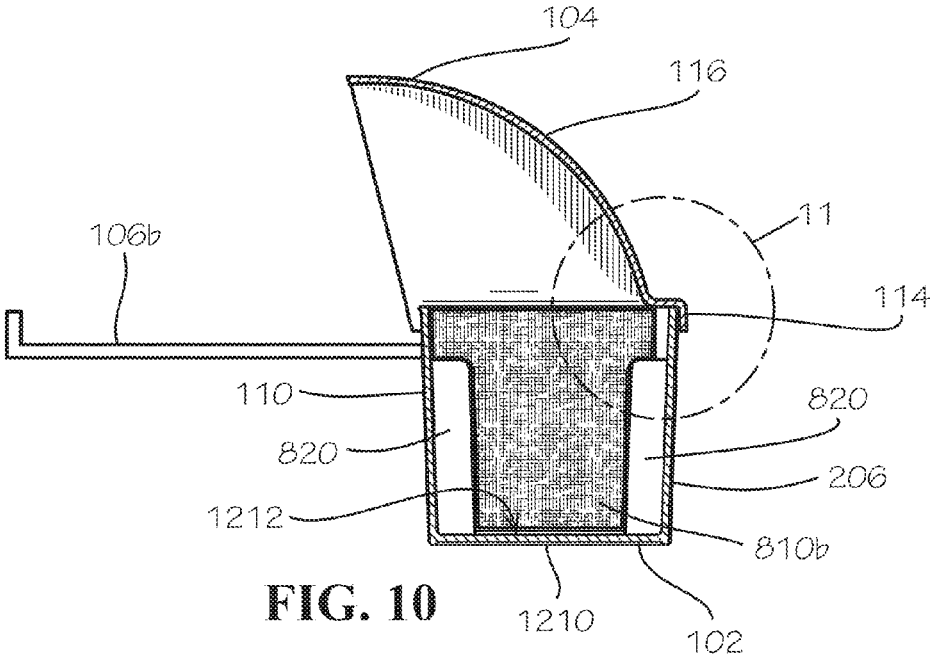
FIG. 10 is a cross-sectional view of the humidifier of FIG. 8 taken along line 10-10 in FIG. 9.

As shown in FIG. 10, the lateral side walls 110 can taper downwards from the top end 200 to the bottom side wall 1210. The lateral side walls 110 can taper both in width and length. Tapering in width can allow the air gaps 1110 to be defined between the square-shaped wicking pads 810*a,b* and the back planar segment 206. As shown in FIG. 11, the top end 200 can define an outer lip 1120 to engage the flange 120 of the cover body 114. The outer lip 1120 can be configured to grip the flange 120 to hold the cover body 114 on the container 102.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A humidifier comprising:

a container comprising a container lateral side wall and defining a container cavity and a container opening defined by an upper edge of the container lateral side wall;

a removable cover removably connected to the container and positioned over the container opening and the container cavity, the removable cover comprising a front side, a back side, a left side, a right side, and a hood comprising a right and a left lateral side wall, and an arcuate-shaped side wall between the lateral side walls, the removable cover defining a body opening, the hood positioned over the body opening, the removable cover defining a plurality of vent openings, the body opening and the vent openings in fluid communication with the container cavity, the vent openings defined between the left lateral side wall of the hood and the left side of the removable cover, and between the right lateral side wall of the hood and the right side of the removable cover;

an attachment mechanism configured to attach the humidifier to an air vent while the removable cover is on the container; and a wicking pad mounted in the container cavity between the vent openings and the body opening;

wherein the humidifier defines an air flow path from the body opening through the container to the vent openings, and the wicking pad is positioned to require the air flow path to pass through the wicking pad.

2. The humidifier of claim 1, wherein the wicking pad is mounted upright in the container cavity.

3. The humidifier of claim 1, the wicking pad is mounted in a pair of mounting channels defined within the container cavity.

4. The humidifier of claim 3, wherein the mounting channels are defined by a plurality of mounting flanges defined in the container lateral side wall.

5. The humidifier of claim 1, wherein the wicking pad contacts a bottom side wall of the container and contacts the removable cover.

6. The humidifier of claim 1, wherein the wicking pad is a first wicking pad, the humidifier further comprising a second wicking pad mounted in the container cavity between the vent openings and the body opening, the second wicking pad configured to require the air flow path to pass through the first wicking pad or the second wicking pad.

7. The humidifier of claim 6, wherein the first wicking pad and the second wicking pad are mounted in the container cavity proximate to opposite sides of the body opening.

8. The humidifier of claim 6, wherein no vent openings are defined on the removable cover between the first wicking pad and the second wicking pad.

9. The humidifier of claim 1, wherein an air gap is defined between the wicking pad, the cover, and the container lateral side wall.

10. The humidifier of claim 1, wherein the container lateral side wall tapers inwards while moving downwards.

11. The humidifier of claim 1, wherein the container lateral side wall defines a support opening, wherein the attachment mechanism comprises a support bar, wherein the support bar engages the container through the support opening, wherein the support bar defines a support bar width, and the support opening defines a support opening width, and the support opening width is greater than the support bar width, and wherein the support opening has a first end and a second end, and wherein the support bar is movably positioned in the support opening between the first end and the second end of the support opening.

12. The humidifier of claim 1, wherein the plurality of vent openings are only defined between the left lateral side wall of the hood and the left side of the removable cover, and between the right lateral side wall of the hood and the right side of the removable cover.

13. The humidifier of claim 1, wherein the wicking pad comprises a top end, and wherein the top end is flush with the body opening.

14. The humidifier of claim 1, wherein:

the container further comprises a container lip, the removable cover further comprises a cover body, the hood mounted on the cover body, the cover body is substantially planar, and the cover body defines a cover brim, the cover brim a projecting edge from the cover body that contacts the container lip.

15. A system comprising:

an air conditioning unit, the conditioning unit comprising a wall-mounted register configured to emit air, the register comprising an air conditioning vent, the air conditioning vent comprising louver bars and vertical support bars supporting the louver bars, one of the louver bars defining an air conditioning vent bar; and a humidifier comprising a container lateral side wall and defining a container cavity and a container opening defined by an upper edge of the container lateral side wall;

a removable cover removably connected to the container and positioned over the container opening and the container cavity, the removable cover comprising a hood and defining a body opening and a vent opening, the hood defining a hood opening, the body opening and the vent opening in fluid communication with the container cavity;

an attachment mechanism attaching the humidifier to the air conditioning vent bar while the removable cover is on the container; and a wicking pad mounted in the container cavity between the vent opening and the body opening;

wherein the system defines an air flow path starting at the air conditioning unit, through the hood opening and the body opening, through the container cavity, and out the vent opening; and wherein the wicking pad is positioned to require the air flow path to pass through the wicking pad.

16. The system of claim 15, wherein the wicking pad is a first wicking pad and the vent opening is a first vent opening, the humidifier defining a second vent opening and further comprising a second wicking pad mounted in the container cavity between the second vent opening and the body opening.

17. The system of claim 15, wherein the wicking pad is mounted upright in a pair of mounting channels defined within the container cavity.

18. The system of claim 15, wherein:

the removable cover further comprises a front side, a back side, a left side, and a right side;

the hood comprises a right and a left lateral side wall, and an arcuate-shaped side wall between the lateral side walls; and the vent opening is a plurality of vent openings, the vent openings only defined between the left lateral side wall of the hood and the left side of the removable cover, and between the right lateral side wall of the hood and the right side of the removable cover.

19. The system of claim 15, wherein the air conditioning unit is a heater.

* * * * *